United States Patent [19]

Kodama et al.

[11] 4,274,876

[45] Jun. 23, 1981

[54] SINTERED HARD METALS HAVING HIGH WEAR RESISTANCE

[75] Inventors: Yujiro Kodama; Nobuhito Kuroishi; Masato Sabao; Yasumasa Kureha, all of Itami, Japan

[73] Assignee: Sumitomo Electric Industries, Ltd., Japan

[21] Appl. No.: 15,178

[22] Filed: Feb. 26, 1979

[30] Foreign Application Priority Data

Mar. 8, 1978 [JP] Japan ..... 53-27123

[51] Int. Cl.[3] ..... B22F 5/00

[52] U.S. Cl. ..... 75/243; 75/246; 75/128 D; 75/128 W

[58] Field of Search ..... 75/246, 243, 128 D, 75/128 W

[56] References Cited

U.S. PATENT DOCUMENTS

| | | | |
|---|---|---|---|
| 3,942,954 | 3/1976 | Frehn | 75/128 W |
| 4,017,711 | 4/1977 | Honma et al. | 75/128 W |
| 4,035,159 | 7/1977 | Hashimoto et al. | 75/246 |

*Primary Examiner*—Brooks H. Hunt

*Attorney, Agent, or Firm*—Wenderoth, Lind & Ponack

[57] ABSTRACT

The invention relates to sintered hard metals obtainable by mixing, pressing and sintering the powders of Cr: 0.2–5%, Ni: 0.5–10%, Mo: 4–12%, Co: 1–10% or C: 0.7–2%, iron powder within the scope of residual Fe, Fe-Mo, Cr-Mo-Co, Mo-Co, Ni-Mo-Cr alloy powders or a carbide powder having Vickers hardness higher than 400 as hard phase components, or calcium fluoride or barium fluoride. The invention has as its object the provision of sintered hard metals having the aforesaid composition for use in sliding members having high wear resistance and processability.

4 Claims, No Drawings

SINTERED HARD METALS HAVING HIGH WEAR RESISTANCE

The invention relates to sintered hard metals for use in sliding members having high wear resistance and processability.

High wear resistant sliding property and processability can be imparted to sintered hard metals by diffusing highly compoundable and wear resistant hard phase components in the base and simultaneously by adding thereto metals having lubricity and low fusing points, glass of a low fusing point, sulfuric compounds and the like.

The invention has as its object the provision of sintered hard metals for use in sliding members having high wear resistance and processability at low cost.

The sintered hard metals according to the invention will now be described with reference to the powder metallurgical method. To iron powder is added a hard phase component comprising Fe-Mo, Cr-Mo or Mo-Co and Ni-Mo-Cr alloy powders or a carbide powder having Vickers hardness higher than 400 a particles size of under 150 mesh and a composition comprising Cr: 0.2–5%, Ni: 0.5–10%, Mo: 4–12%, Co: 1–10% and C: 0.7–2%, and also 0.2–10% of calcium fluoride or barium fluoride. The mixture is pressed and sintered for 15–60 minutes in a reducing atmosphere at 1000°–1250° C. to obtain sintered hard metals.

Chromium in the composition is added in the form of powder of Fe-Cr, Ni-Mo-Cr or Cr-Mo-Co alloy, the alloy powder being diffused in the surrounding iron base, thereby contributing to the reinforcement of the matrix and the improvement of resistance to heat and oxidization.

If the addition of Cr is less than 0.2%, a sufficient effect is unobtainable, whilst if it is more than 5%, the growth of a lubricating oxide of Co and Mo, which will be described in detail hereinafter, is checked. Thus, it is preferable that the amount of Cr is controlled within a scope of 0.2–5% in the ultimate composition.

Nickel added in the form of Ni individually or a powder of Ni-Mo-Cr alloy contributes to the reinforcement of ferrite and the improvement of the toughness of the base. The effect is small if the addition is less than 0.5%, whilst if more than 10%, the effect is unchanged or adversely the precision and strength are undesirably affected by austenite remaining in the part of excessive addition. The preferable range, therefore, is 0.5–10%.

Mo is added partly in the form of Fe-Mo alloy powder and partly in the form of Cr-Mo-Co or Ni-Mo-Cr alloy powder, the chief actions thereof being as follows.

(1) It is partly diffused in the iron base in the course of sintering thereby improving the heat resistance of the base.

(2) It is partly left as it stands in the form an undiffused alloy phase thereby improving the wear resistance of the hard phase.

(3) It forms a lubricating oxide in the form of MoO together with Co due to generation of heat or high temperature atmosphere during the sliding operation thereby increasing the resistance to searing.

The mixing ratio of Cr-Co-Mo or Ni-Mo-Cr powder with Fe-Mo powder is preferably about 1:1. If the ultimate Mo ratio is less than 4%, the aforesaid effect is undesirably insufficient, whilst the effect is not perceptibly improved even when it is more than 12%. From the viewpoint of economy, therefore, the range from 4 to 12% is practical. Co is added in the form of Co-Mo or Cr-Co-Mo alloy powder and acts the same as Mo as follows.

(1) It is rapidly diffused in the surrounding iron base in the course of sintering thereby improving the interfacial strength between the hard phase and the base.

(2) It forms a lubricating oxide due to generation of heat or high temperature atmosphere during the sliding operation thereby improving the resistance to searing.

If the ultimate Co ratio is less than 1%, the addition of Co-Mo or Cr-Co-Mo compound phase is not sufficient to obtain the aforesaid effect, whilst addition of more than 10% does not help to perceptibly improve said effect. It be preferable, therefore, that the amount of addition of Co-Mo or Cr-Co-Mo compound is controlled between 1–10% in the ultimate Co ratio.

Carbon is solidly dissolved in iron thereby reinforcing the ferrite, whilst it is partly educed as cementite thereby contributing to the improvement of resistance to wear and heat. If less than 0.7%, the effect of reinforcement of ferrite and that of improving the wear resistance of the base are small, whilst if more than 2%, the amount of network-like cementite is increased resulting in deterioration of the material. The range from 0.7 to 2%, therefore, is suitable. Calcium fluoride and barium fluoride are added as lubricating elements capable of precluding adhesion of metals in a high heat atmosphere thereby enabling to increase the resistance to searing and processability.

Calcium fluoride and barium fluoride are stable up to very high temperatures, the decomposition temperatures thereof being 1373° C. and 1280° C., respectively. They are free from the danger of decomposition and disappearance in so far as the sintering temperature is lower than 1250° C. The property of lubricity is stable up to a high temperature of about 700° C. and imparts high wear resistance to the members according to the invention. If the addition of calcium fluoride or barium fluoride is less than 0.2%, the effect of improving the resistance to searing is not sufficient, whilst if more than 10%, the strength is greatly reduced. The range of addition, therefore, is preferably 0.2–10%.

The invention will be described in more detail with reference to the following example.

EXAMPLE

Carbon powder and nickel powder of below 325 mesh, Fe-60%Mo, Co-30%Mo-10%Cr, Ni-35%Mo-15%Cr or Co-50%Mo alloy powder of below 150 mesh, calcium fluoride or barium fluoride powder of below 250, and atomized iron powder of below 100 mesh were mixed in accordance with the undermentioned ratio of composition. The mixtures were compressed into a density of 85–86% and then sintered for 30 minutes at a temperature of 1100° C. in an atmosphere of hydrogen. The materials thus obtained were subjected to examination of mechanical properties and tests of wear resistance and workability. The figures in the following table of compositions denote weight %, Fe being the residue thereof.

(A) Fe-0.5Cr-6Mo-5Co-2Ni-1C
(B) Fe-2Cr-6Mo-5Co-2Ni-1$CaF_2$-1C
(C) Fe-5Cr-6Mo-5Co-2Ni-1$CaF_2$-1C
(D) Fe-1Cr-12Mo-10Co-0.5Ni-1$CaF_2$-1C
(E) Fe-2Cr-6Mo-5Co-2Ni-5$CaF_2$-1C
(F) Fe-1Cr-8Mo-6Co-2Ni-1$CaF_2$-0.7C
(G) Fe-1Cr-8Mo-6Co-2Ni-1$CaF_2$-1.5C
(H) Fe-1Cr-6Mo-4Co-5Ni-1$CaF_2$-1C (I) Fe-1Cr-6Mo-4Co-2Ni-1$BaF_2$-1C
(J) Fe-1.5Cr-4Mo-5Ni-1C
(K) Fe-5Cr-12Mo-2Ni-1C
(L) Fe-3Cr-7Mo-10Ni-1C
(M) Fe-3Cr-7Mo-10Ni-1C-1$CaF_2$

The mechanical properties of each sample are shown in Table 1.

TABLE 1

| Sample | Density ratio | Harndess | Radial crushing strength |
|---|---|---|---|
| A | 86% | 85 RB | 53 Kg/mm$^2$ |
| B | 85 | 88 | 46 |
| C | 83 | 90 | 42 |
| D | 85 | 90 | 48 |
| E | 83 | 80 | 40 |
| F | 87 | 84 | 55 |
| G | 83 | 86 | 39 |
| H | 86 | 83 | 42 |
| I | 85 | 88 | 48 |
| J | 87 | 84 | 54 |
| K | 85 | 90 | 47 |
| L | 85 | 89 | 51 |
| M | 83 | 87 | 48 |

The samples, A to M, were subjected to the Ogoshi-type wear resistance test which will be described in detail hereinafter. The test conditions were as follows.

1. Test load: 2.2 kg
2. Friction speed: 4 m/sec
3. Friction distance 200 m
4. Lubrication: nil (dry type)
5. Opponent material: JIS SUH3 (Hardness $H_{RC}35$)

By way of comparison, Cu-Cr-Mo alloy cast iron, highspeed steel, Fe-5Cr-2Ni-3Co-3W-1C (sintered hard metal 1) and Fe-20Cr-10Ni-0.3P-1C-5Pb (sintered hard metal 2) were subjected to the same test. The results are shown in Table 2.

TABLE 2

| | Sample | Friction amount(mg/cm$^2$) |
|---|---|---|
| Material of Invention | A | 4.0 |
| | B | 3.0 |
| | C | 2.2 |
| | D | 2.5 |
| | E | 1.0 |
| | F | 8.1 |
| | G | 4.5 |
| | H | 6.5 |
| | I | 1.8 |
| | J | 4.1 |
| | K | 3.1 |
| | L | 2.4 |
| | M | 1.3 |
| Material for Comparison | Cu—Cr—Mo cast iron | 15.0 |
| | high-speed steel | 8.2 |
| | sintered hard metal 1 | 8.0 |
| | sintered hard metal 2 | 7.5 |

As is apparent from the aforementioned results, the sintered hard metals according to the invention showed higher resistance to wear than that of cast iron, high-speed steel and heat resistant sintered hard metals containing Pb which had been conventionally known as materials having high wear resistance. This is presumably due to the fact that the sintered hard metals according to the invention comprise a hard phase having high wear resistance and a fluoride as a lubricating element.

We claim:

1. Sintered hard metals having high wear resistance and consisting essentially of Ni: 0.5–10%, Cr: 0.2–5%, Mo: 4–12% and C: 0.7–2.0%, each by weight, the remainder being iron.

2. Sintered hard metals having high wear resistance as defined in claim 1 wherein sintered hard metal particles 20–70$\mu$ of Fe-Mo (Mo content 50–70 weight %) and Ni-Mo-Cr (Mo content 20–50 weight %; Cr content 5–30 weight %) are additionally present at 5–30 weight % in total.

3. Sintered hard metals having high wear resistance as defined in claim 1 containing 0.2–10 weight % of a fluoride.

4. Sintered hard metals having high wear resistance as defined in claim 3 wherein said fluoride is calcium fluoride or barium fluoride.

* * * * *